US008615944B2

(12) United States Patent
Maziarz

(10) Patent No.: US 8,615,944 B2
(45) **Date of Patent: *Dec. 31, 2013**

(54) STOP BEAD FOR SEPARATING STUCCO MATERIAL FROM A FRAME OF A WINDOW OR DOOR

(75) Inventor: Jeffrey Maziarz, Royersford, PA (US)

(73) Assignee: E-Z Bead LLC, Royersford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/931,079

(22) Filed: Jan. 24, 2011

(65) Prior Publication Data

US 2011/0271615 A1 Nov. 10, 2011

Related U.S. Application Data

(62) Division of application No. 11/981,421, filed on Oct. 31, 2007, now Pat. No. 7,874,123, which is a division of application No. 11/259,499, filed on Oct. 26, 2005, now abandoned, which is a division of application No. 09/952,920, filed on Sep. 17, 2001, now abandoned.

(51) Int. Cl.
*E04B 1/66* (2006.01)
*E04B 1/68* (2006.01)

(52) U.S. Cl.
USPC ..... 52/273; 52/214; 52/288.1

(58) Field of Classification Search
USPC ..... 52/741.4, 741.3, 741.41, 742.1, 256, 52/157, 187.1, 214, 273, 254, 288.1, 287.1
See application file for complete search history.

(56) References Cited

U.S. PATENT DOCUMENTS

| | | | | |
|---|---|---|---|---|
| 1,030,044 | A | 6/1912 | Whittbecker | |
| 1,361,843 | A | 12/1920 | Flagge | |
| 1,386,509 | A | 8/1921 | Kirmes et al. | |
| 1,673,971 | A * | 6/1928 | Dowell | 52/241 |
| 1,679,914 | A * | 8/1928 | Murray | 52/347 |
| 1,840,221 | A | 1/1932 | Bridges | |
| 1,886,320 | A | 11/1932 | Waite | |
| 2,031,249 | A | 2/1936 | Bowman | |
| 2,189,216 | A | 2/1940 | Mathias | |
| 2,272,162 | A | 2/1942 | Lackey | |

(Continued)

*Primary Examiner* — Phi A
(74) *Attorney, Agent, or Firm* — John F. A. Earley, III; Frank J. Bonini, Jr.; Harding, Earley, Follmer & Frailey, P.C.

(57) ABSTRACT

A stop bead for mounting along a frame or jamb of a window or door of a building to separate the frame or jamb from plaster or stucco material during application of the plaster or stucco material to the building comprises a first side end portion and a second side end portion, the first side portion having a leading edge for engaging the frame or jamb when the stop bead is mounted adjacent to the frame or jamb, a base panel having a front face, a wall formed on the base panel and extending outwardly above the front face of the base panel, the wall having an engaging surface for engaging plaster or stucco and a frame/jamb facing surface that faces the frame or jamb when the stop bead is mounted adjacent to the frame or jamb, and a spacing member formed on the stop bead and extending outwardly away from the frame/jamb facing surface of the wall for spacing the wall a predetermined distance from the frame or jamb when the stop bead is mounted adjacent to the frame or jamb, the spacing member forming the leading edge of the first side portion of the stop bead and forming gap between the wall and the frame or jamb when the stop bead is mounted adjacent to the frame or jamb.

15 Claims, 3 Drawing Sheets

(56) References Cited

U.S. PATENT DOCUMENTS

| | | | | | |
|---|---|---|---|---|---|
| 2,286,890 | A | | 6/1942 | Birt | |
| 2,725,608 | A | | 12/1955 | Parslow | |
| 2,732,045 | A | | 1/1956 | Herlocker | |
| 2,742,120 | A | | 4/1956 | Rosebrook | |
| 2,845,666 | A | * | 8/1958 | Knapp | 52/287.1 |
| RE24,658 | E | | 6/1959 | Hollister | |
| 2,904,992 | A | | 9/1959 | Cruser | |
| 2,953,835 | A | * | 9/1960 | Armstrong et al. | 249/188 |
| 3,192,577 | A | * | 7/1965 | Barr | 52/364 |
| 3,201,908 | A | | 8/1965 | Arnold | |
| 3,213,577 | A | | 10/1965 | Levin | |
| 3,319,384 | A | | 5/1967 | Berg | |
| 3,349,519 | A | | 10/1967 | Nehlig | |
| 3,398,494 | A | * | 8/1968 | Larson | 52/371 |
| 3,512,318 | A | | 5/1970 | Turner | |
| 3,608,254 | A | | 9/1971 | Sklamberg et al. | |
| 3,619,944 | A | | 11/1971 | Matvey | |
| 3,667,174 | A | * | 6/1972 | Arnett | 52/100 |
| 3,765,138 | A | | 10/1973 | Bentle | |
| 3,782,680 | A | | 1/1974 | Hopkins | |
| 3,922,826 | A | | 12/1975 | Molyneux | |
| 4,038,791 | A | | 8/1977 | Atkinson | |
| 4,505,079 | A | | 3/1985 | Black | |
| 4,545,162 | A | | 10/1985 | Attaway | |
| 4,651,488 | A | * | 3/1987 | Nicholas et al. | 52/396.02 |
| 4,663,883 | A | | 5/1987 | Hilliard et al. | |
| 4,726,148 | A | | 2/1988 | Ti | |
| 4,763,455 | A | * | 8/1988 | Schneller | 52/255 |
| 4,785,601 | A | | 11/1988 | Tupman | |
| 4,829,731 | A | | 5/1989 | Schluter | |
| 5,014,471 | A | | 5/1991 | Ballstadt | |
| 5,073,430 | A | * | 12/1991 | Aidan | 428/43 |
| 5,127,204 | A | * | 7/1992 | Braun | 52/417 |
| 5,181,357 | A | | 1/1993 | Pourtau et al. | |
| 5,210,986 | A | | 5/1993 | Hagemeyer et al. | |
| 5,222,343 | A | | 6/1993 | Anderson | |
| 5,230,738 | A | * | 7/1993 | Wheeler | 118/504 |
| 5,305,566 | A | | 4/1994 | Larkowski | |
| 5,313,755 | A | | 5/1994 | Koenig, Jr. | |
| 5,333,432 | A | * | 8/1994 | Schluter | 52/396.1 |
| 5,423,154 | A | * | 6/1995 | Maylon et al. | 52/371 |
| 5,430,981 | A | | 7/1995 | Scott | |
| D364,233 | S | | 11/1995 | Caley | |
| 5,544,445 | A | | 8/1996 | Mantilla | |
| 5,551,201 | A | | 9/1996 | Anderson | |
| 5,579,623 | A | | 12/1996 | Stark et al. | |
| 5,699,638 | A | | 12/1997 | Maylon | |
| 5,761,866 | A | | 6/1998 | Maylon | |
| 5,791,116 | A | * | 8/1998 | Skintzis | 52/741.4 |
| 5,950,370 | A | | 9/1999 | Peck | |
| 5,970,671 | A | | 10/1999 | Bifano et al. | |
| 6,018,924 | A | | 2/2000 | Tamlyn | |
| 6,119,416 | A | | 9/2000 | Larson | |
| 6,122,883 | A | * | 9/2000 | Braun | 52/717.01 |
| 6,223,486 | B1 | | 5/2001 | Dunham | |
| 6,298,609 | B1 | | 10/2001 | Bifano et al. | |
| 6,308,475 | B1 | | 10/2001 | Crish, II et al. | |
| 6,322,045 | B1 | | 11/2001 | Andros | |
| 6,338,229 | B1 | | 1/2002 | Botzen | |
| D456,528 | S | | 4/2002 | Maylon et al. | |
| 6,367,210 | B1 | | 4/2002 | Trundle | |
| 6,425,216 | B1 | | 7/2002 | Gardner | |
| 6,490,831 | B1 | | 12/2002 | Candusso | |
| D471,991 | S | | 3/2003 | Maylon et al. | |
| 6,631,595 | B1 | | 10/2003 | Minter | |
| 6,705,047 | B2 | | 3/2004 | Yulkowski | |
| 7,406,805 | B1 | * | 8/2008 | Larson | 52/371 |
| 7,526,897 | B2 | | 5/2009 | Collins | |
| 7,634,883 | B1 | | 12/2009 | Larson et al. | |
| 2002/0124504 | A1 | | 9/2002 | Maylon et al. | |
| 2004/0020143 | A1 | | 2/2004 | Webb | |

* cited by examiner

STOP BEAD FOR SEPARATING STUCCO MATERIAL FROM A FRAME OF A WINDOW OR DOOR

CROSS REFERENCE TO RELATED APPLICATIONS

This application is a divisional application of U.S. patent application Ser. No. 11/981,421 and claims priority and benefit under 35 U.S.C. §120 of U.S. patent application Ser. No. 11/981,421, which was filed on Oct. 31, 2007 and which is incorporated herein by reference and which is a divisional application of U.S. patent application Ser. No. 11/259,499 and claims priority and benefit under 35 U.S.C. §120 of U.S. patent application Ser. No. 11/259,499, which was filed on Oct. 26, 2005 and which is incorporated herein by reference and which is a divisional application of U.S. patent application Ser. No. 09/952,920 and claims priority and benefit under 35 U.S.C. §120 of U.S. patent application Ser. No. 09/952,920, which was filed on Sep. 17, 2001 and which is incorporated herein by reference.

STATEMENT REGARDING FEDERALLY SPONSORED RESEARCH OR DEVELOPMENT

This invention was not made, invented or otherwise promoted by any federally sponsored research or development grants, monies or other financial or other support. It was developed in an entirely private fashion by the inventor.

FIELD OF THE INVENTION

This invention relates to the application of stucco or plaster in homes or other buildings and specifically to the stop system used between the edge of the stucco or plaster surface and the adjoining frame for windows and doors.

BACKGROUND OF THE INVENTION

Stucco and/or plaster are typically used for both interior and exterior surfaces in home or commercial building construction. Stucco or plaster is routinely applied to a galvanized wire mesh over felt paper which has been attached to underlying plywood or other sheathing material. (See FIG. 1.) In order to provide a smooth edge where the stucco or plaster meets a door or window jamb or frame, plastic stop strips are installed along the desired edge of the stucco or plaster to contain it and provide for an even finish.

The plastic stop often used for this purpose is presented in FIG. 2. The plaster stop generally consists of a perforated plastic strip approximately 2 inches wide with a plastic lip or edge acting to contain the stucco or plaster away from the jamb or frame. The plaster stop is typically installed approximately ¼ inch away from the jamb or frame, leaving a gap between the stop and the backing surface. In order to provide a complete finish, the worker must install a backer rod into the gap and then apply a finishing layer of caulk. This process that is used by some builders to prevent leaks is very time consuming.

This method of stucco installation has often resulted in leaking problems between the stucco or plaster surface and the adjacent jamb, thereby causing significant additional repair costs and frustration to both home owners and construction companies. In addition, the extra time and materials necessary for installation of the backer rod and finishing caulk layer can add considerably to the costs and duration of the construction. The L-Bead eliminates the need for installation of a backer rod—saving considerable time and money—and significantly cuts down on the potential for leaks around windows and doors.

BRIEF SUMMARY OF THE INVENTION

The present invention, L-Bead system, provides a system for quick, efficient and lower cost installation of stucco and or plaster which cuts down on the potential for leaks around windows and doors. The L-Bead is used as a stop between the edge of the stucco or plaster surface and the adjacent jamb or window/door frame. Proper installation of existing plaster stop requires a ¼ inch gap between the stop and the jamb, mandating the installation of a backer rod and supplemental caulking. The L-Bead system eliminates this need by adding an extra plastic strip or "lip" along the edge of existing plaster stop which abuts directly to the jamb, thereby simplifying a smooth finish and minimizing the potential for leaks.

DETAILED DESCRIPTION OF THE INVENTION

Figure 1:
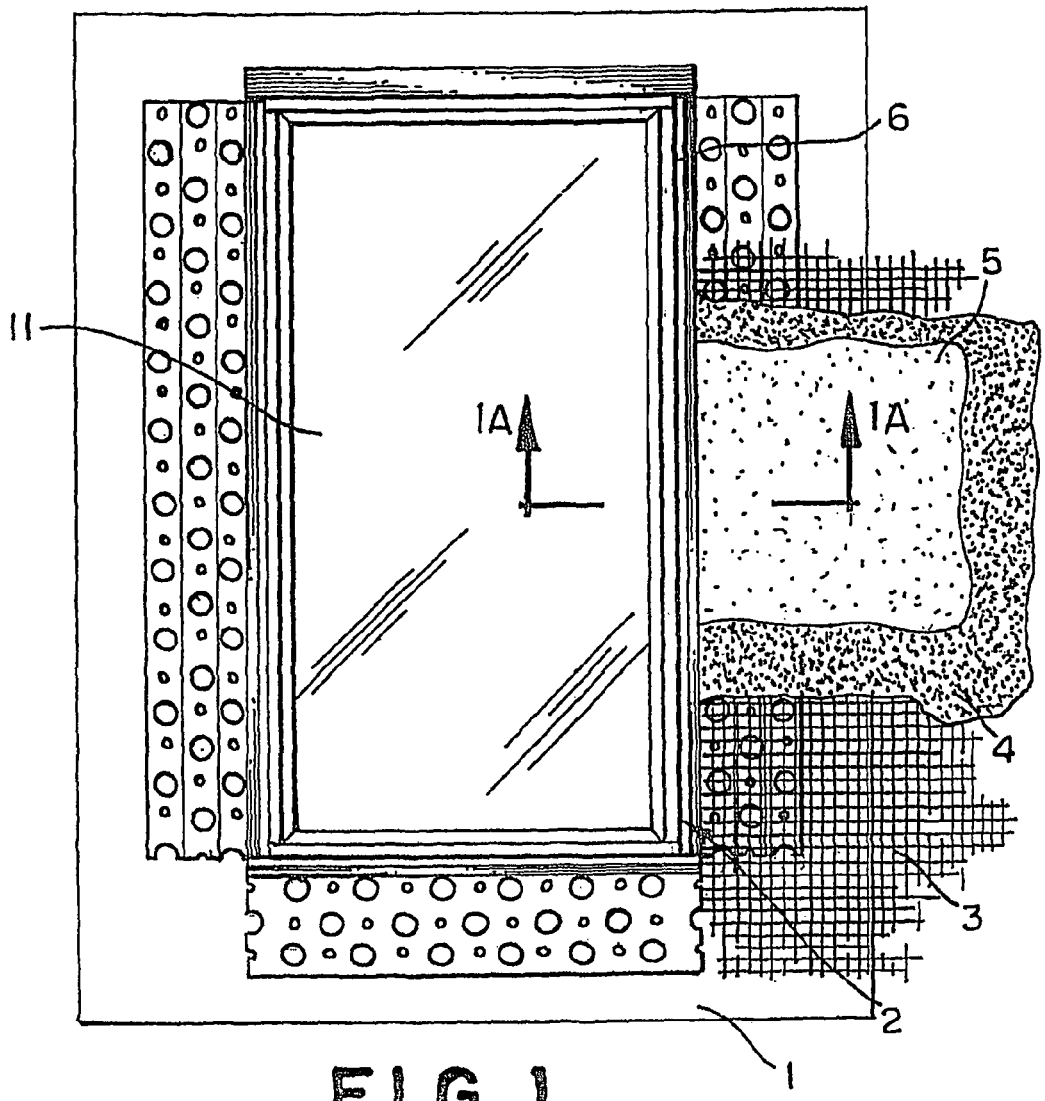
FIG. 1 shows the typical manner in which stucco or plaster will be applied and installed in homes or other buildings around window or door frames or adjacent to other surfaces such as aluminum siding using the L-Bead system. Such construction occurs in layers, with each layer given a number in order of installation. A wire mesh layer of galvanized wire (#3) is anchored over felt paper (#1) to the backing wall (usually plywood or a similar material). Scratch and finish coats of plaster or stucco (#4 and #5) are applied to the wire layer. Where the stucco or plaster meets a window or door jamb or another surface, plastic L-Bead stopping strips (#2) are nailed to the backing wall behind or adjacent to the galvanized wire layer. The edge of the stop closest to the jamb is raised to contain the stucco or plaster and keep it away from the jamb or frame. The key to the L-bead is the separate backing "lip" along the plastic stop which directly abuts the jamb or other surface. No backing rod is necessary. A final small layer of caulk (#6) is applied to finish the job.
Figure 1A:
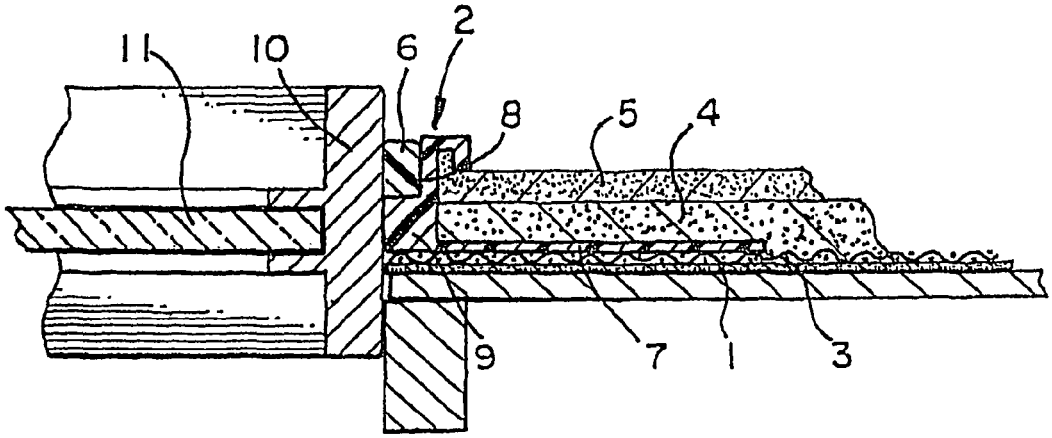
FIG. 1A is a view in cross-section taken along the lines and arrows 1A-1A, illustrating the inventive stop or stop bead 2 mounted along a jamb 10 of a window 11.

The L-Bead system significantly reduces the time and costs necessary to install smooth finishes where stucco or plaster meets window or door frames or jamb. In ordinary house of building construction, exterior and interior surfaces are often made of stucco or plaster. The method of installation of these materials is generally consistent in the construction business and usually involves the installation of a felt layer over the backing wall (plywood or similar material), a galvanized wire (or lathe) layer, and both scratch and finish coats of stucco or plaster. (See FIG. 1.)

Figure 2:
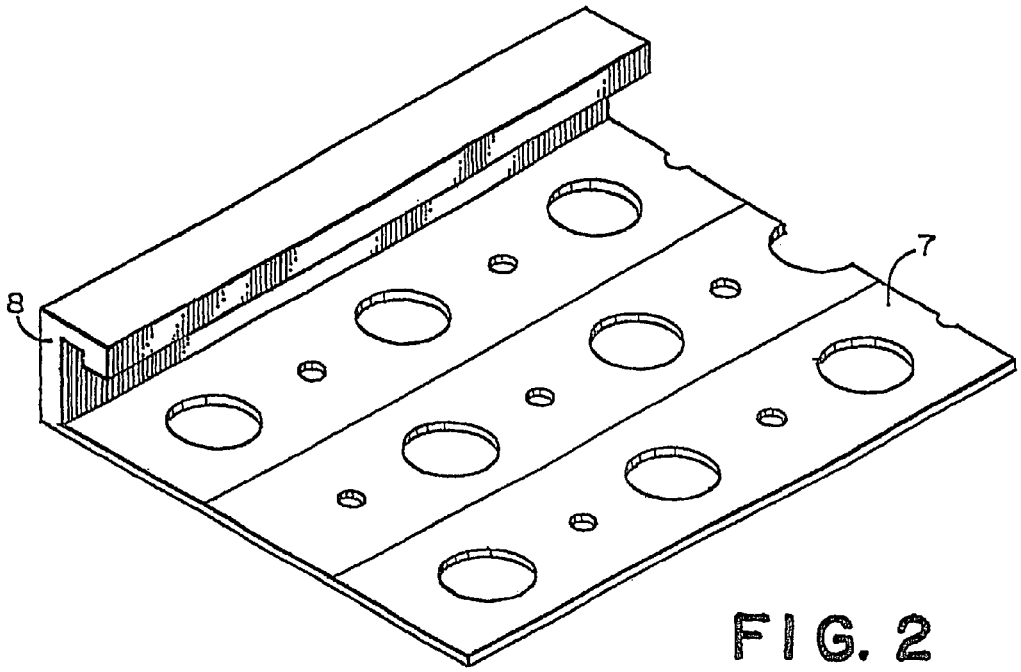
FIG. 2 PRIOR ART
FIG. 2 is a drawing showing an enlarged view of existing plaster stop. The perforated portion of the plaster stop is nailed or otherwise attached to the backing wall. The lip on the edge of the plaster stop acts to contain the plaster or stucco and keep it away from the door or window jamb.

Leaking and other problems often occur where the stucco or plaster finish aligns with other design constructs of the home or building, such as windows or doors. Stop strips which contain and form the outer boundaries of the stucco or plaster surfaces where they meet window or door jambs have been developed to improve the seal and finishes of these adjacencies. In particular, the use of standard plaster stop strips as shown in FIG. 2 has become standard practice in the stucco and masonry business.

However, for traditional plaster stop to be properly installed and finished, the worker typically installs the plaster stop ¼ inch from the edge of the door or window jamb. The resulting gap must be filled with a backing rod and properly caulked for the correct finish. Installation of this backing rod and additional caulking costs time and money, particularly where the architectural design calls for numerous windows, doors or other interruptions in stucco or plaster surfaces. In addition, this manner of construction has unfortunately resulted in frequent leaking problems around windows and doors.

The inventor has come up with a system which eliminates the need for installation of a backing rod by manufacturing an additional strip of plastic which is bound to the existing plaster stop and abuts directly against the jamb or other surface. The L-Bead system significantly modifies both the existing plaster stop unit itself and the ease of installation.

Plaster stop strips routinely consist of a thin, 2-inch wide strip 7 of plastic which is perforated throughout its length and which contains an edge strip 8 of plastic approximately ½ inch high running along one side of the strip 7. The top ¼ inch of this additional plastic strip 8 is then bent back over the wide, perforated portion strip 7 forming a "lip" which runs along the entire length of the stop. See FIG. 2. When the plaster stop is nailed to the backing wall, it is installed approximately ¼ inch away from the jamb or other surface. The lip side contains and holds the stucco or plaster in place providing a smooth, straight edge.

Because traditional plaster stop must be installed ¼ inch from the jamb for it to perform properly, there remains a ¼ inch gap running the entire length of the adjacency between the stucco and the door or window jamb. In typical construction, this gap is filled with a backing rod and requires considerable caulking which often leads to leaking or other problems. The L-Bead system eliminates this last step and will greatly improve construction techniques for reducing leaks in windows or doors.

Figure 3:
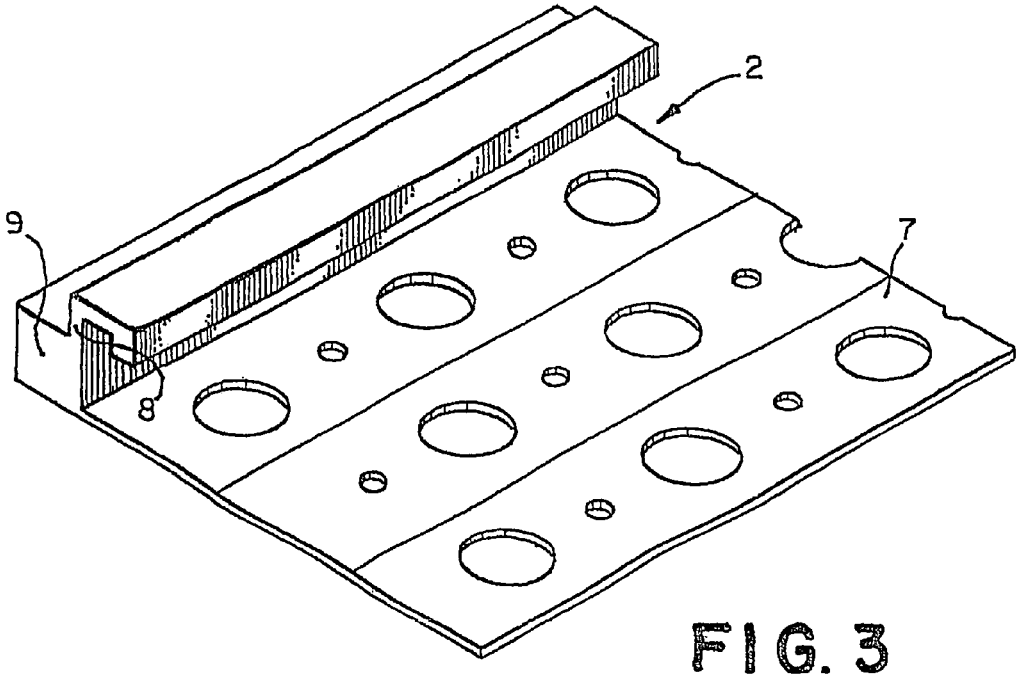
FIG. 3 shows the new L-Bead. As with traditional plaster stop, the perforated portion is nailed or otherwise attached to the backing wall. The higher lip part of the stop contains the stucco or plaster. The added backing lip of the L-Bead abuts directly to the jamb and eliminates the need for a backer rod, thereby cutting down on both leaks and installation time.
Figure 4:
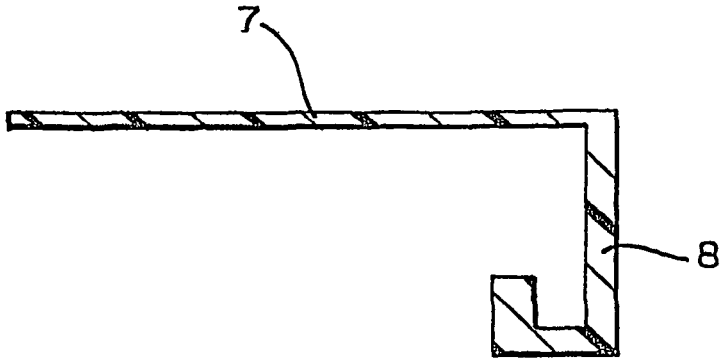
FIG. 4 PRIOR ART
FIG. 4 is a view in cross-section of the prior art stop or stop bead shown in FIG. 2.
Figure 5:
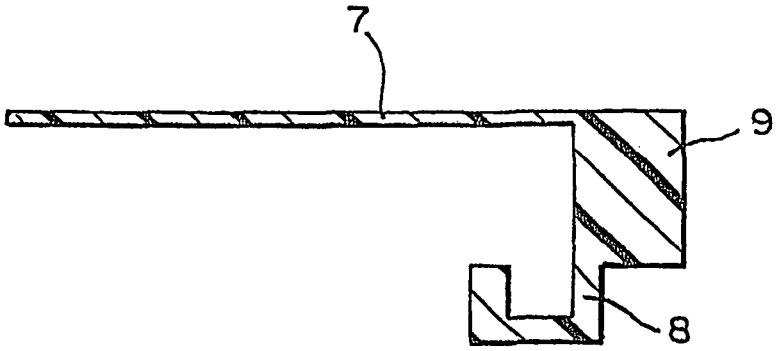
FIG. 5 is a view in cross-section of the inventive stop or stop bead 2 shown in FIG. 3.

The L-Bead system alters traditional plaster stop by adding a separate backing strip 9 to the existing plaster stop. The additional length of plastic stripping 9 is attached to the outside of the lip and runs along the entire length of the stop 2. (See FIG. 3.) Whereas the original plaster stop contained the stucco or plaster, the L-Bead system not only contains the stucco or plaster, but also provides a backing strip 9 which abuts directly against the jamb 10 or other surface and thereby eliminates the need for (and serves the purpose of) a backing rod and additional caulking. Because the additional backing strip 9 is located lower than the lip containing the stucco, it can account for variations in the jamb 10 or other surface. A simple and thin caulking 6 over the L-Bead, where it meets the jamb 10 or other surface, makes for a smooth, leakproof finish.

L-Bead eliminates the need for backing rods around windows, doors or any other place where stucco or plaster meets a different surface. Given that a typical house design includes numerous windows, doors, garages, or other architectural interruptions in stucco surfaces, the elimination of backer rods and simplified construction associated with the L-Bead system will save millions of dollars in construction costs and will greatly improve such finishes against leaking or other problems.

What is claimed is:

1. A wall, the wall having a jamb formed therein, the jamb being part of a frame that frames an opening in the wall, and the jamb having a first surface facing the opening in the wall and a second surface facing away from the opening in the wall, a stop bead mounted on the wall against the second surface of the jamb to separate the jamb from plaster or stucco material during application of the plaster or stucco material to the wall, the stop bead comprising a first side end portion and a second side end portion, the first side end portion having a leading edge engaging the second surface of the jamb when the stop bead is mounted adjacent to the jamb, a base panel having a front face, a stop bead wall formed on the base panel and extending outwardly above the front face of the base panel, the stop bead wall having a first side and a second side, the first side of the stop bead wall having an engaging surface for engaging plaster or stucco material, and the second side of the stop bead wall having a jamb facing surface that faces the second surface of the jamb when the stop bead is mounted adjacent to the jamb, and a spacing member formed on the stop bead and extending outwardly away from the jamb facing surface of the stop bead wall spacing the stop bead wall a predetermined distance from the second surface of the jamb when the stop bead is mounted adjacent to the jamb, the spacing member forming the leading edge of the first side end portion of the stop bead, the leading edge having a jamb engaging surface engaging the second surface of the jamb when the stop bead is mounted adjacent to the jamb, and the spacing member in conjunction with the jamb and the jamb facing surface of the stop bead wall forming a caulk receiving area above the spacing member and between the second surface of the jamb and the jamb facing surface of the stop bead wall for receiving caulk to seal between the stop bead and the jamb, caulk positioned in the caulk receiving area and contacting the stop bead and the jamb to form a seal between the stop bead and the jamb, and plaster or stucco material applied to the wall and separated from the jamb by the stop bead.

2. The wall of claim 1, the caulk positioned in the caulk receiving area contacting the second surface of the jamb and the jamb facing surface of the stop bead wall to form the seal between the stop bead and the jamb.

3. The wall of claim 1, the stop bead having a first end portion and a second end portion, and the spacing member being a strip formed on the stop bead adjacent to the jamb facing surface of the stop bead wall and extending between the first end portion and the second end portion.

4. The wall of claim 1, the stop bead wall having an upper end portion, and the stop bead wall having a flange formed in its upper end portion to assist in containing plaster or stucco, the flange having a first portion that extends laterally away from the stop bead wall and over the base panel and a second portion extending from the first portion downwardly toward the base panel.

5. The wall of claim 1, the base panel having perforations formed therein.

6. The wall of claim 1, the stop bead having a first height at the spacing member, and the stop bead having a second height at the base panel between the stop bead wall and the second side edge portion, the first height being higher than the second height.

7. The wall of claim 2, the caulk positioned in the caulk receiving area contacting the jamb and the jamb facing surface of the stop bead wall to form a seal between the stop bead and the jamb.

8. The wall of claim 2, the stop bead having a first height at the spacing member, and the stop bead having a second height at the base panel between the stop bead wall and the second side edge portion, the first height being substantially higher than the second height.

9. A stop bead for mounting along a frame or jamb of a window or door of a building to separate the frame or jamb from plaster or stucco material during application of the plaster or stucco material to the building, comprising:

a first side end portion and a second side end portion, the first side end portion having a leading edge for engaging the frame or jamb when the stop bead is mounted adjacent to the frame or jamb, a base panel having a front face and a bottom face, the bottom face being adapted to be mounted against a wall, the stop bead having a highest point and a lowest point, the bottom face of the base panel defining the lowest point of the stop bead, a stop bead wall formed on the base panel and extending outwardly above the front face of the base panel, the stop bead wall having an engaging surface for engaging plaster or stucco and a frame/jamb facing surface that faces the frame or jamb when the stop bead is mounted adjacent to the frame or jamb, and a spacing member formed on the stop bead and extending outwardly away from the frame/jamb facing surface of the stop bead wall for spacing the stop bead wall a predetermined distance from the frame or jamb when the stop bead is mounted adjacent to the frame or jamb, the spacing member forming the leading edge of the first side end portion of the stop bead, the leading edge having a frame/jamb engaging surface for engaging the frame/jamb when the stop bead is mounted adjacent to the frame or jamb, the spacing member having an upper end portion having an outer surface, the outer surface of the upper end portion of the spacing member being higher than the front face of the base panel, the spacing member forming a caulk receiving area for receiving caulk to seal between the stop bead and the frame or jamb, the caulk receiving area being located above the outer surface of the upper end portion of the spacing member, with the outer surface of the upper end portion of the spacing member defining a bottom end of the caulk receiving area, the caulk receiving area being open from above to permit access to the caulk receiving area from above to permit caulk to be applied in the caulk receiving area from above to seal between the stop bead and the frame or jamb, the base panel establishing a plane that is coplanar with the base panel, the stop bead having a first height at the spacing member, the first height extending from the plane that is coplanar with the base panel to the outer surface of the upper end portion of the spacing member, the stop bead having a second height at the stop bead wall, the second height extending from the base panel to the upper end of the stop bead wall, and the first height of the stop bead at the spacing member being greater than one half of the second height of the stop bead at the stop bead wall.

10. The stop bead of claim 9, the outer surface of the upper end portion of the spacing member being a ledge.

11. The stop bead of claim 9, the stop bead having a first end portion and a second end portion, and the spacing member being a strip formed on the stop bead adjacent to the frame/jamb facing surface of the stop bead wall and extending between the first end portion and the second end portion.

12. The stop bead of claim 9, the stop bead wall having an upper end portion, and the stop bead wall having a flange formed in its upper end portion to assist in containing plaster or stucco, the flange having a first portion that extends laterally away from the wall and over the base panel and a second portion extending from the first portion downwardly toward the base panel.

13. The stop bead of claim 9, the base panel having perforations formed therein.

14. A stop bead for mounting along a frame or jamb of a window or door of a building to separate a frame or jamb from plaster or stucco material during application of the plaster or stucco material to the building, comprising:

a first side end portion and a second side end portion, the first side end portion having a leading edge for engaging the frame or jamb when the stop bead is mounted adjacent to the frame or jamb, a base panel having a front face and a bottom face, the bottom face being adapted to be mounted against a wall, the stop bead having a highest point and a lowest point, the bottom face of the base panel defining the lowest point of the stop bead, a stop bead wall formed on the base panel and extending outwardly above the front face of the base panel, and means formed on the stop bead for contacting the frame or jamb when the stop bead is mounted adjacent to the frame or jamb, for spacing the stop bead wall a predetermined distance from the frame or jamb when the stop bead is mounted adjacent to the frame or jamb, and for receiving caulk to seal between the stop bead and the frame or jamb when the stop bead is mounted adjacent to the frame or jamb, said means forming the leading edge of the first end portion of the stop bead, said means having an upper end portion having an outer surface, the outer surface of the upper end portion of said means being higher than the front face of the base panel, said means including a caulk receiving area for receiving caulk to seal between the stop bead and the frame or jamb, the caulk receiving area being located above the outer surface of the upper end portion of said means, with the outer surface of the upper end portion of said means defining a bottom end of the caulk receiving area, the caulk receiving area being open from above to permit access to the caulk receiving area from above to permit caulk to be applied in the caulk receiving area from above to seal between the stop bead and the frame or jamb, the base panel establishing a plane that is coplanar with the base panel, the stop bead having a first height at said means, the first height extending from the plane that is coplanar with the base panel to the outer surface of the upper end portion of said means, the stop bead having a second height at the stop bead wall, the second height extending from the base panel to the upper end of the stop bead wall, and the first height of the stop bead at said means being greater than one half of the second height of the stop bead at the stop bead wall.

15. The stop bead of claim 14, the base panel having perforations formed therein.

* * * * *